US009669648B1

(12) United States Patent
Chang

(10) Patent No.: US 9,669,648 B1
(45) Date of Patent: Jun. 6, 2017

(54) LOOSE-LEAF BINDER DEVICE

(71) Applicant: Sun L. Chang, Taichung (TW)

(72) Inventor: Sun L. Chang, Taichung (TW)

( * ) Notice: Subject to any disclaimer, the term of this patent is extended or adjusted under 35 U.S.C. 154(b) by 0 days.

(21) Appl. No.: 15/171,469

(22) Filed: Jun. 2, 2016

(51) Int. Cl.

| | |
|---|---|
| ***B42B 5/10*** | (2006.01) |
| ***B42F 13/00*** | (2006.01) |
| ***B42F 3/06*** | (2006.01) |
| ***B42F 3/00*** | (2006.01) |

(52) U.S. Cl.
CPC ..... *B42F 3/06* (2013.01); *B42B 5/10* (2013.01); *B42F 3/003* (2013.01); *B42F 13/0066* (2013.01)

(58) Field of Classification Search
CPC ..... B42F 13/0066; B42D 5/10
USPC ..... 402/60, 75; 281/27.1, 27.2
See application file for complete search history.

(56) References Cited

U.S. PATENT DOCUMENTS 4,773,787 A * 9/1988 Chang ..... B42B 5/10 402/60
5,009,537 A * 4/1991 Stengel ..... B42B 5/10 402/60
5,037,229 A * 8/1991 Stengel ..... B42F 3/06 402/60
6,406,208 B1 * 6/2002 Hsu ..... A45D 40/00 15/104.93
7,341,390 B2 * 3/2008 Chang ..... B42B 5/10 402/60
2008/0298882 A1 * 12/2008 Huang ..... B42B 5/10 402/68

FOREIGN PATENT DOCUMENTS

GB CH 288445 A * 1/1953 ..... B42B 5/10

* cited by examiner

*Primary Examiner* — Kyle Grabowski
(74) *Attorney, Agent, or Firm* — C. G. Mersereau; Nikolai & Mersereau, P.A.

(57) ABSTRACT

A loose-leaf binder device comprises a back, two end plugs that can selectively close two ends of the back, and a loose-leaf coil for binding inner pages and selectively disposed below the back. The back is formed with an insert slot. A retaining hole communicating with the insert slot is formed on a portion of the back abutting upon an end edge. The end plug is integrally formed with a resilient member to be inserted into the insert slot. A top surface of the resilient member is formed with one post corresponding to the retaining hole of the back. A free end of the resilient member is formed with an upward compressing edge. Thus, the post on the resilient member can be actuated through a compressing edge according to the resilient member of the end plug so that the post is selectively engaged with or disengaged from the back.

4 Claims, 5 Drawing Sheets

LOOSE-LEAF BINDER DEVICE

BACKGROUND OF THE INVENTION (1) Field of the Invention

The invention relates in general to the technical field for binding loose-leaf papers, and more particularly to a loose-leaf binder device, which can be operated by one single hand and has the good positioning effect, so that the loose-leaf papers can be replaced easily and conveniently and the beauty and the standing stability can be enhanced concurrently.

(2) Description of the Prior Art

Typically, the methods of binding books may be classified into a fixed binding method and a loose-leaf binding method, wherein the fixed book has inner stacked pages with lateral side edges being adhered, and has the advantage that the inner pages cannot be easily peeled and lost, but has the drawbacks that the book cannot be effectively leveled, that the use of the inner edge is affected, that the user has to use his/her hand to smoothen the book so that the writing can be easily performed, that the inner pages cannot be updated, added or removed, and that other inner pages are often successively detached once one of the inner pages is detached so that the notebook is damaged. In the loose-leaf book, the lateral side edge of the inner stacked page is formed with one row of binding holes, and a helical binder coil disposed on a board sequentially passes through the binding holes, so that the inner pages are selectively mounted to the helical binder coil, and then the helical binder coil is closed. The advantage thereof is that the inner pages can be deployed by 360 degrees. However, the drawback thereof is that the outer diameter of the helical binder coil has to be greater than a double of the thickness of the book for the purpose of easy use. However, such configuration causes the pages to become loose to cause the indecent phenomenon and affect the beauty thereof. In addition, the helical binder coil needs to be rotated upon loading or unloading of the inner pages, so that the helical binder coil sequentially goes into or out of each binding hole in a helical manner. In addition, the helical binder coil needs to be completely detached from the loose-leaf book, so that the inner pages of the loose-leaf book can be replaced. However, such the loading and unloading method is extremely time-consuming, and cannot be easily operated so that a lot of inconvenience in use may be caused.

In view of the above-mentioned problems of the conventional loose-leaf book, the present inventor has developed a loose-leaf binder with the easy loading and unloading in U.S. Pat. No. 7,341,390 B2, wherein the loose-leaf binder is composed of an open coil formed on one side, a back engaging with an opening of the coil in a sliding manner, and two end plugs inserted into two ends of the back. After the inner loose-leaf pages are loaded from the opening of the coil, the back may directly slide to close the opening of the coil. Then, the end plugs on the two ends prevent the coil from coming off to achieve the object of forming the loose-leaf book. On the contrary, when the inner pages need to be replaced, added or removed, the end plugs are reversely removed and the back can be moved out, so that the attachment and detachment become easy.

However, when the inner pages of the loose-leaf binder are to be replaced, added or removed, the end plugs are inserted into the two ends of the back by the large frictional force between the inner surface of the back and the end plug. When the gap therebetween is too large and causes the too-loose condition, the end plug tends to slip out. If the gap therebetween is too small and causes the too-tight condition, the end plug cannot be easily inserted, and a larger force is needed to remove the end plug so that the end plug is frequently damaged. Furthermore, the end plug tends to be combined with the coil and the end portion of the coil tends to be pulled out when the end plug is pulled out, thereby affecting the overall operation smoothness. In addition, one hand needs to press the latch of the end plug passing through the back, and the other hand's thumb and index fingers need to nip the end plug cover and pull it out, so that the end plug can be separated from the back. Thus, two hands have to be used to complete the overall attachment and detachment operations of the end plug. In addition, when the fingers nip the end plug cover, the area thereof is smaller, and the fingers often nip the two sides of the end portion of the back, so that the friction force for pulling out the end plug is increased to cause the trouble in operation. In addition, when the coil passes through the back, the coil is somewhat compressed longitudinally. Because the coil is not effectively positioned, rubbing and twitching of the coil often occur after the end plug is pulled out, and the coil tend to come off or fail due to the deformation. Thus, the loose-leaf binder still has some drawbacks to be improved.

In view of this, the prevent inventor has paid attention to the research and development to overcome the problems of the existing loose-leaf binder according to the experience and the technology in researching and developing the associated products for many years, and thus developed this loose-leaf binder device to overcome the troubles that the existing positioning effect is poor, that the deformation is caused due to the frictional force for pulling the end plug, that the operation is laborious and that both hands are needed to complete the operation.

SUMMARY OF THE INVENTION

It is therefore a main object of the invention to provide a loose-leaf binder device to position a coil without causing rubbing relative to the coil when an end plug is being pulled out. Thus, it is possible to prevent the coil from being arbitrarily loosened and to enhance the operation convenience.

Another main object of the invention is to provide a loose-leaf binder device having end plugs which can be pressed and pulled out, so that the inner pages can be easily replaced, added or removed.

Still another main object of the invention is to provide a loose-leaf binder device capable of making the thickness of the book approach the width of the coil, so that the page capacity can be increased, the page tightness is better, the pages can be effectively deployed, and the overall beauty is enhanced.

The invention mainly achieves the above-identified objects and effects by providing a loose-leaf binder device disposed on a loose-leaf book. The loose-leaf binder device comprises a back, two end plugs and a loose-leaf coil.

The back comprises a lower sheet and an upper sheet. Two parallel upright baffles are formed between the lower sheet and the upper sheet, so that a space surrounded by the lower sheet, the upper sheet and the two upright baffles is formed with an insert slot. Portions of the two ends of the upper sheet abutting upon an end edge are respectively formed with retaining holes communicating with the insert slot. A track with a downward opening is formed on each of two opposite outer sides of the two upright baffles between the lower sheet and the upper sheet.

The two end plugs are to be inserted into the two ends of the back. The end plug comprises a base cover and a plug body for closing one of the two opposite ends of the back. Two sides of the plug body are formed with two side tines to be inserted into the tracks of two sides of the back, respectively. A receiving slot is formed between the two side tines. The plug body is integrally formed with a curve-shaped resilient member in the receiving slot. The resilient member may be inserted into the insert slot of the back. A top surface of the resilient member is formed with one post corresponding to the retaining hole of the back. A free end of the resilient member is formed with an upward compressing edge. The base cover can correspondingly cover an end portion of the plug body, so that an insert space into which an end portion of the back can be inserted is formed between an outer surface of the plug body and an inner surface of the base cover. A middle of an end edge of the base cover is formed with a through hole through which the compressing edge projects;

The loose-leaf coil to be selectively disposed below the back is formed with continuous C-shaped portions by bending a wire, and each of two ends of each of the C-shaped portions is formed with a track section to slide in the track of the back.

Accordingly, the loose-leaf binder device of the invention can be implemented by the above-mentioned technological means. The design that the end plug has the resilient member and that the middle section of the top surface and the free end of the resilient member have the post and the compressing edge can be utilized, so that the post on the resilient member can be actuated through the compressing edge and selectively engaged with or disengaged from the back, and the user can use one single hand to operate the engagement and disengagement between the end plug and the back. So, the operation convenience can be effectively enhanced. In addition, the number of inner papers or pages through which the loose-leaf coil passes can be increased, the overall smoothness and beauty can be enhanced according to its special property, the added value can be increased, and the economic effectiveness can be enhanced.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
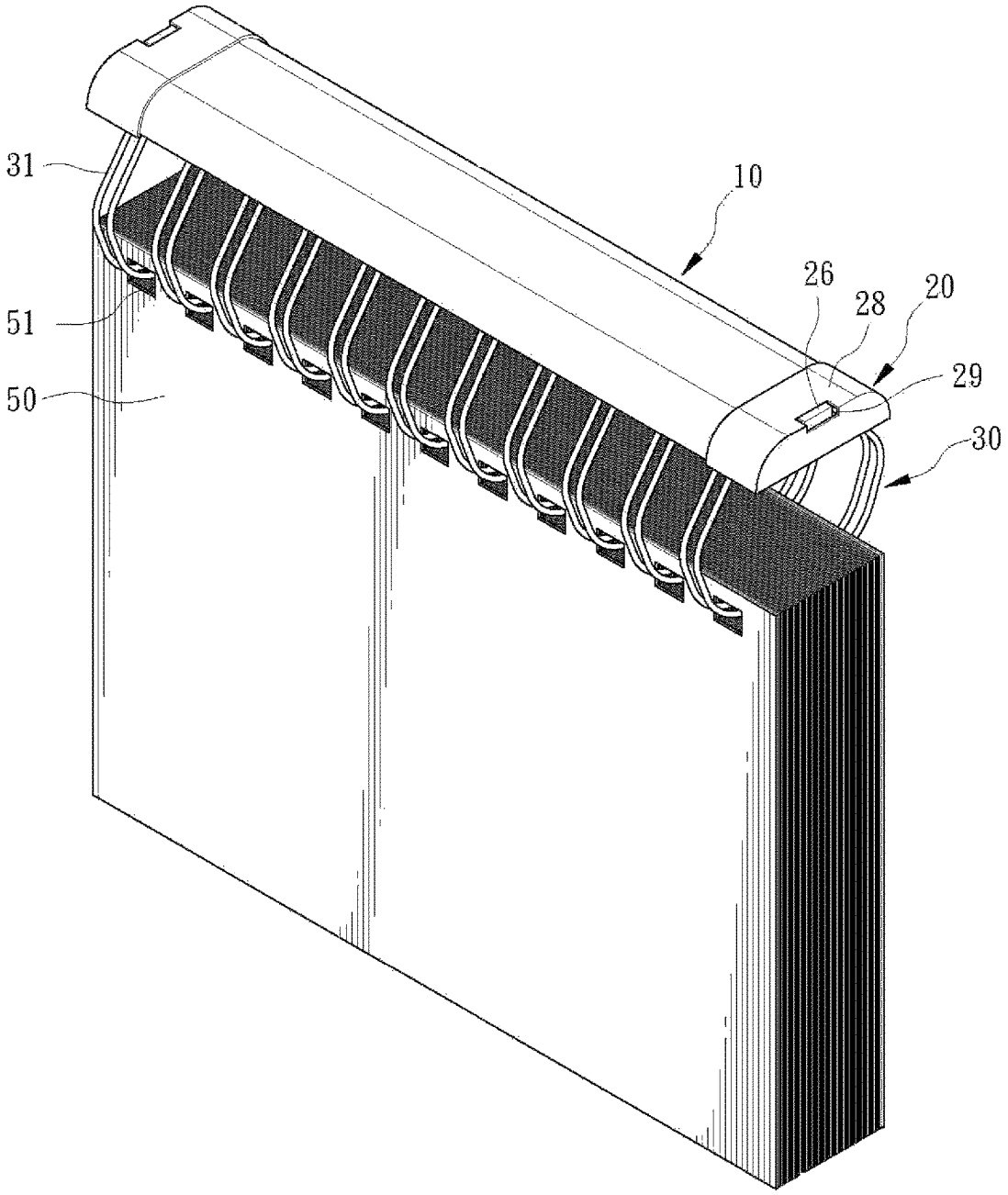
FIG. 1 is a schematic view showing a pictorial exterior of a loose-leaf binder device of the invention combined with a loose-leaf book.

The invention relates to a loose-leaf binder device having the specific embodiment to be exemplified with reference to the accompanying drawings, wherein the relative terms, such as "front," "rear," "left," "right," "top," "bottom," "upper," "lower," "horizontal" and "vertical", may be used herein for ease of description to describe the invention. The relative terms do not restrict the invention, and do not restrict the member to any position or spatial orientation. The dimensions specified in the drawings or specification may be modified according to the design and requirement of the specific embodiment of the invention without departing from spirit or scope of the claimed invention.

Figure 2:
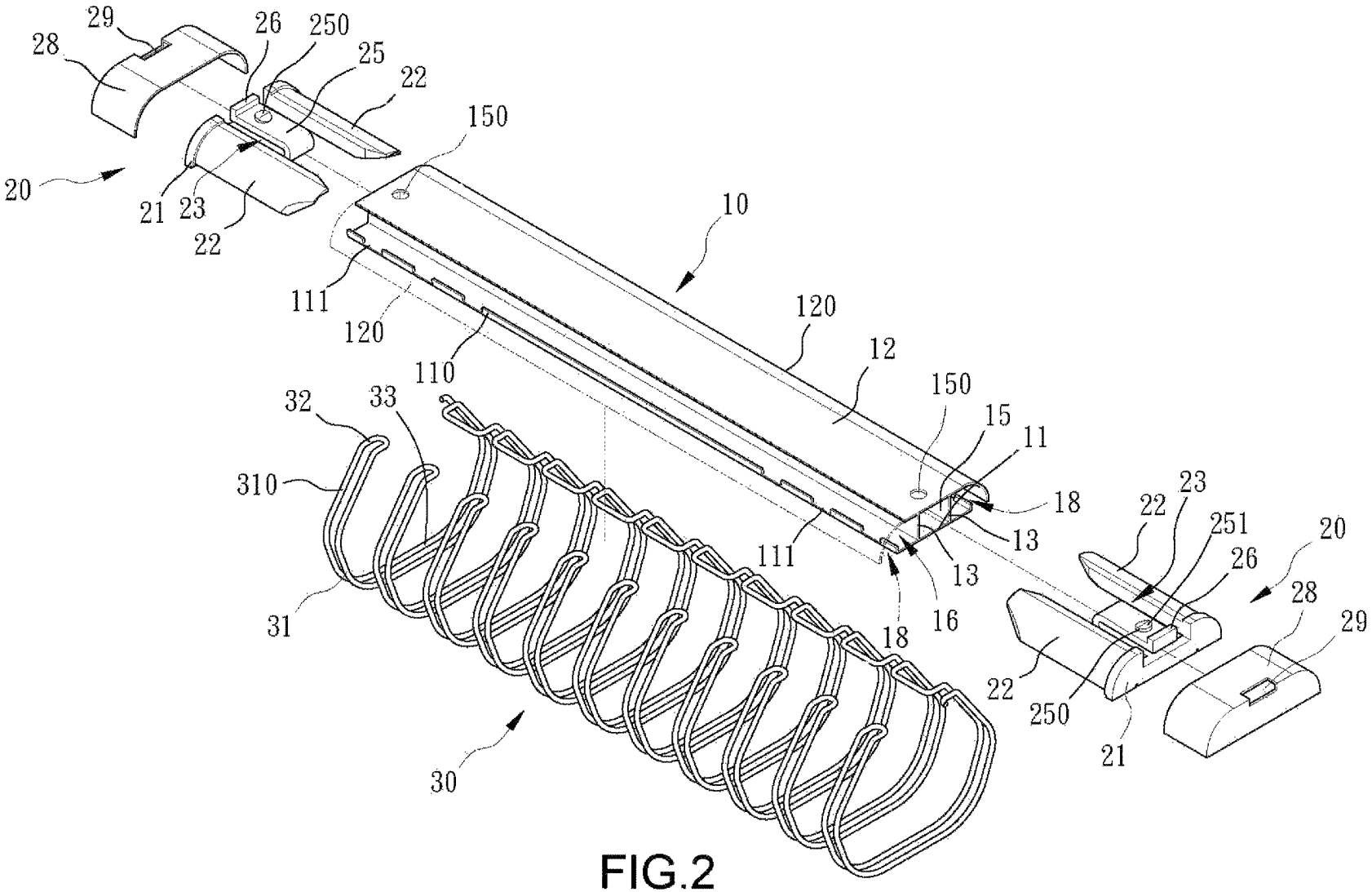
FIG. 2 is a pictorially schematically decomposed view showing the loose-leaf binder device of the invention for the purpose of illustrating the aspects and the relative relationships of the main elements.

The detailed construction of the loose-leaf binder device of the invention is shown in FIGS. 1 and 2. The loose-leaf binder device comprises a back (10), at least one end plug (20) and a loose-leaf coil (30) combined together, so that the loose-leaf coil (30) can be used to bind binding holes (51) of the side edge of the paper (50).

The back (10) comprises a lower sheet (11), an upper sheet (12) and two parallel upright baffles (13) between the lower sheet (11) and the upper sheet (12), so that the back (10) forms an I-shaped longitudinal body. A space surrounded by the lower sheet (11), the upper sheet (12) and the two upright baffles (13) is formed with an insert slot (15). At least one end of two ends of the back (10) is formed with an open end portion. A portion of the upper sheet (12) abutting upon an end edge corresponding to the open end portion is formed with a retaining hole (150) communicating with the insert slot (15), so that the end plug (20) can be selectively engaged and positioned with the retaining hole (150). In addition, two tracks (16) are respectively formed on two opposite outer sides of the two upright baffles (13) between the lower sheet (11) and the upper sheet (12). Furthermore, two sides of the upper sheet (12) are formed with two downward extending arced edge portions (120), respectively, so that an opening (18) is formed between the bottom edge of the arced edge portion (120) of the upper sheet (12) and the edge of the lower sheet (11), and the loose-leaf coil (30) can go out of and slide in the opening (18). Moreover, one slightly upwardly projecting flange (110) is formed on each of two lateral side edges of the lower sheet (11). Also, the lower sheet (11) is formed with at least one engaging slot (111) on at least one of two ends of the flange (110), and the engaging slot (111) is for engaging and limiting the loose-leaf coil (30).

The end plug (20) can be inserted into each open end portion of the back (10). Also, the end plug (20) comprises a plug body (21) for closing each of opposite ends of the back (10), and a base cover (28), wherein the two sides of the plug body (21) are formed with side tines (22) to be inserted into the two side tracks (16) of the back (10), respectively, and a receiving slot (23) is formed between the two side tines (22). The plug body (21) is formed with a U-shaped resilient member (25) in the receiving slot (23). The resilient member (25) may be inserted into the insert slot (15) of the back (10). Also, the top surface of the resilient member (25) is formed with a post (250) corresponding to the retaining hole (150) of the back (10), and the top surface of the post (250) is formed with a downward inclined surface (251) corresponding to the back (10) so that the post (250) of the resilient member (25) can be easily snapped into the retaining hole (150). Furthermore, the free end of the resilient member (25) is formed with an upward compressing edge (26). The base cover (28) can correspondingly cover the end portion of the plug body (21) with the covering range exceeding the post (250), so that an insert space (see FIG. 4A) into which the end portion of the back (10) can be inserted is formed between the outer surface of the plug body (21) and the inner surface of the base cover (28). The middle of the end edge of the base cover (28) is formed with one through hole (29) corresponding to the compressing edge (26) of the resilient member (25), so that the compressing edge (26) can project through the through hole (29) and be pressed by the user to separate the post (250) of the resilient member (25) from the retaining hole (150) of the back (10), and to facilitate the selective engagement and disengagement between the end plug (20) and the back (10).

The loose-leaf coil (30) can be selectively disposed below the back (10), and is formed by bending a wire to have several continuous C-shaped portions (31). Each of two ends of each C-shaped portion (31) is formed with a track section (32) to slide in the track (16) of one of the two sides of the back (10). Furthermore, each of the upper sections of the two sides of each C-shaped portion (31) of the loose-leaf coil (30) is formed with an inclined expanding section (310) corresponding to the arced edge portion (120) of the upper sheet (12) of the back (10), so that the bottom edge of each C-shaped portion (31) is formed with a level section (33), which has the width equal to the width of the back (10) and can pass through the inner papers (50). Thus, the number of the inner papers (50) through which the loose-leaf coil (30) passes can be increased, and the book becomes neater and stabler to enhance the beauty when being placed in an upright manner.

Thus, a beautiful loose-leaf binder device that can be operated by one single hand can be constructed.

Figure 3:
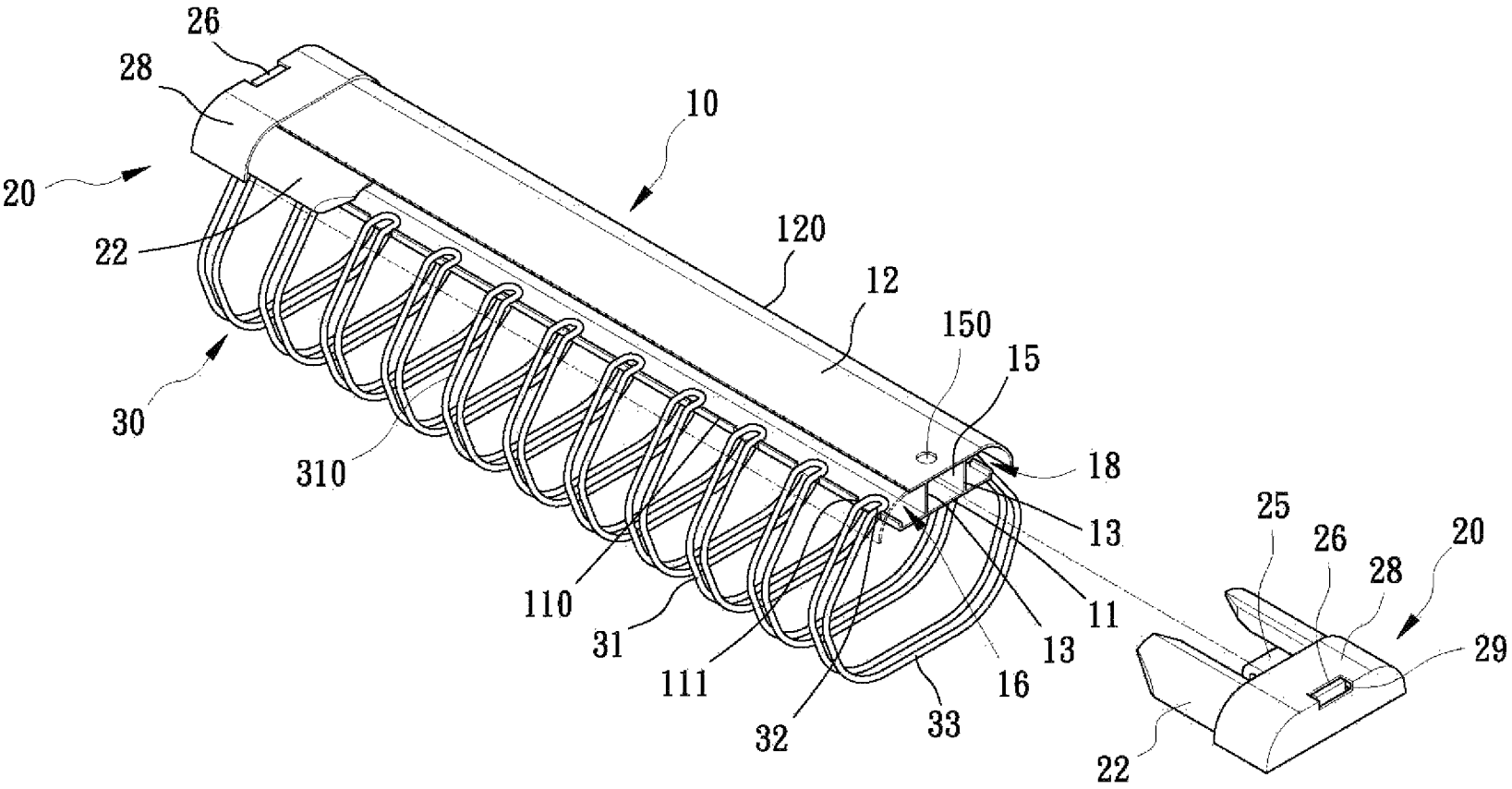
FIG. 3 is a schematic view showing the pictorial exterior of the loose-leaf binder device of the invention for the purpose of illustrating the state of the combination.
Figure 4B:
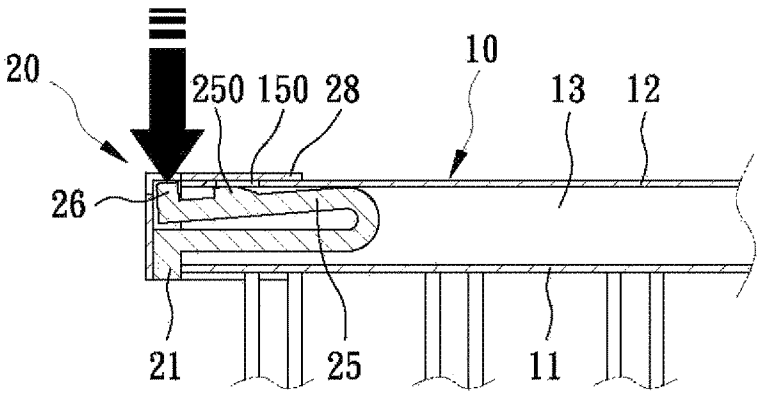
FIGS. 4A and 4B are partially cross-sectional side views showing the loose-leaf binder device of the invention for the purpose of illustrating the operation state of the holding plate and the end plug.
Figure 4A:
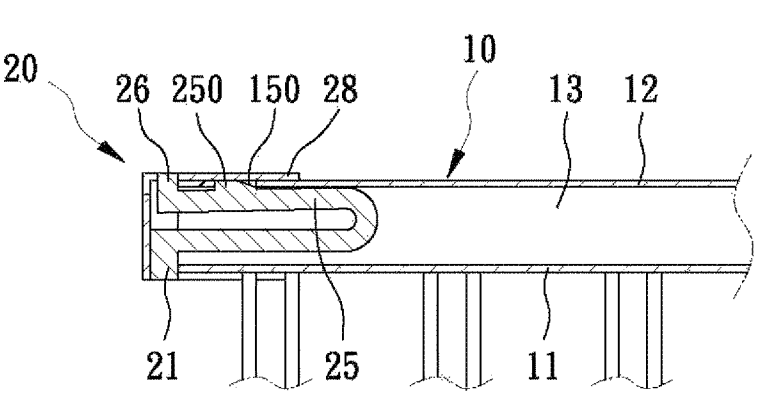
Figure 5:
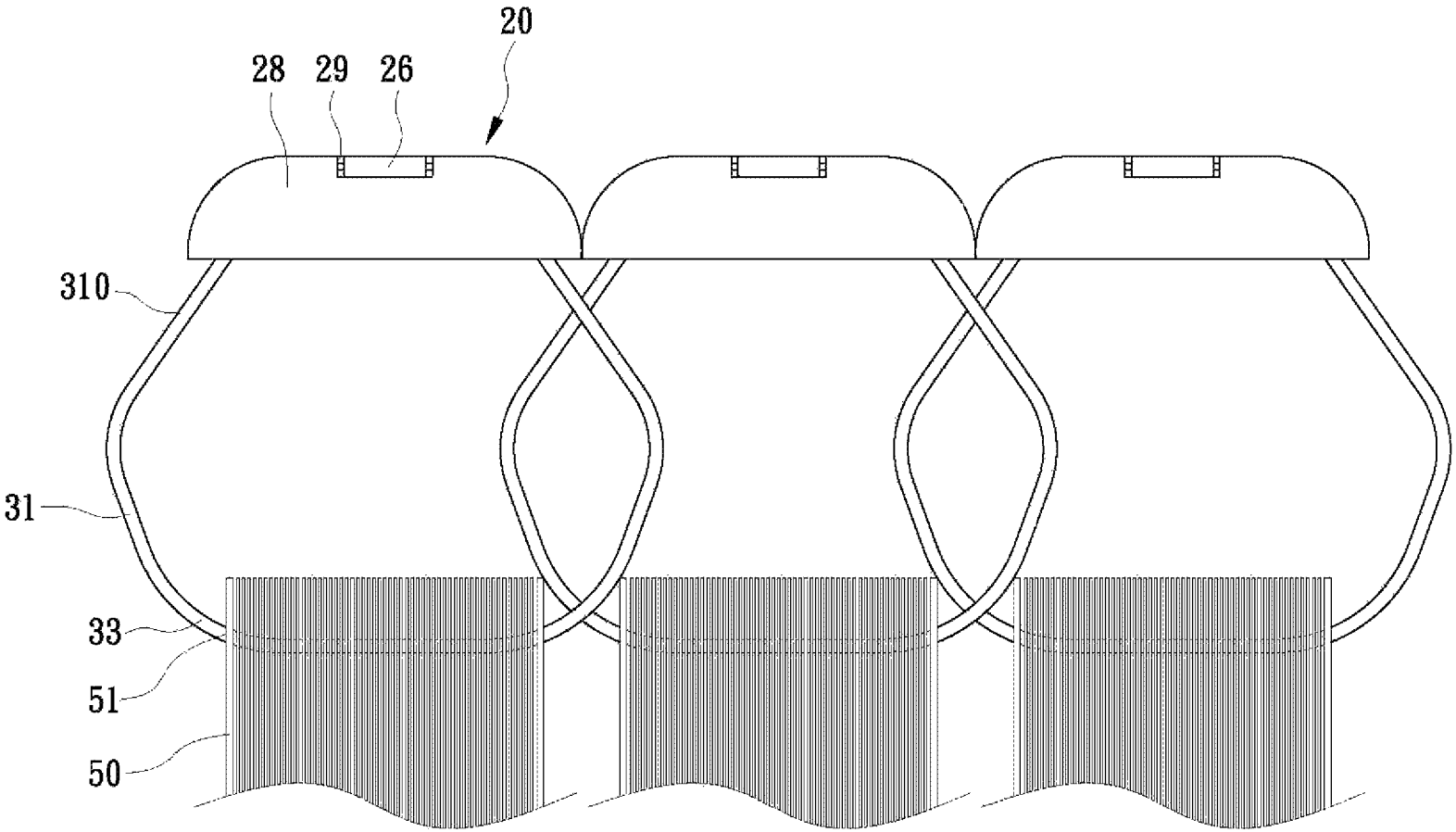
FIG. 5 is a schematic top view showing the loose-leaf binder device of the invention for the purpose of illustrating the placement state when the fewer loose-leaf pages are present.

As shown in FIGS. 3 to 5, when the invention is actually used, one of the track sections (32) of each C-shaped portion (31) of the loose-leaf coil (30) is firstly inserted into the binding holes (51) of the papers (50), and then one end of the loose-leaf coil (30) is aligned with one end of the back (10), so that the track sections (32) of the two ends of the loose-leaf coil (30) can be concurrently pushed into the tracks (16) of the two sides of the back (10), and the track section (32) of the loose-leaf coil (30) is in flat surface contact with the flange (110) of the lower sheet (11) of the back (10). At this time, the C-shaped portions (31) and the back (10) form an annular closed state so that the papers (50) cannot be detached from the C-shaped portions (31). Next, the track sections (32) of the C-shaped portions (31) of the two ends of the loose-leaf coil (30) are inserted into the engaging slots (111) of the lower sheet (11) of the back (10), so that the two ends of the loose-leaf coil (30) can be restricted on the back (10) without arbitrarily coming off.

Next, the side tines (22) and the resilient members (25) of the end plugs (20) on the two ends are sequentially aligned with the two side tracks (16) and the insert slots (15) of the two ends of the back (10), and the post (250) of the resilient member (25) is engaged with the retaining hole (150) of the back (10) (see FIG. 4A), so that the end plugs (20) are inserted into two ends of the back (10) (see FIG. 1) to bind the loose-leaf papers (50) into one book.

When the papers (50) of the loose-leaf book are to be replaced, added or removed, the index finger of one hand can be used to support the bottom surface of the end plug (20), and the thumb can be used to press the compressing edge (26), so that the post (250) of the resilient member (25) of the end plug (20) can be separated from the retaining hole (150) of the upper sheet (12) of the back (10) (see FIG. 4B). At this time, the user only needs to directly pull out the end plug (20) to separate the end plug (20) from the back (10). Because the loose-leaf coil (30) is restricted by the engaging slot (111) of the lower sheet (11) of the back (10), the loose-leaf coil (30) cannot easily come off, and the user can easily take out the loose-leaf coil (30), and further remove the papers (50) of the loose-leaf book from the loose-leaf coil (30) to perform the replacement, addition or removing.

According to the above-mentioned description, it is obtained that the loose-leaf binder of the invention has the following advantages and effects.

First, the design that the two side flanges (110) of the lower sheet (11) of the back (10) are formed with the engaging slots (111) can be utilized, so that the C-shaped portions (31) of the two ends of the loose-leaf coil (30) can be restricted, the C-shaped portions (31) of the loose-leaf coil (30) can be held equally spaced, and it is possible to prevent the loose-leaf coil (30) from arbitrarily coming off after the end plugs (20) are removed from the two ends of the back (10).

Second, because the C-shaped portion (31) of the loose-leaf coil (30) is inserted into the engaging slot (111) of the back (10) and the side tine (22) of the end plug (20) is attached to the inner surface of the back (10), the loose-leaf coil (30) cannot be rubbed when the end plug (20) is pulled, the displacement of the loose-leaf coil (30) cannot be caused, and the operation convenience can be enhanced.

In addition, the end plug (20) has the resilient member (25), and the post (250) of the resilient member (25) can be selectively engaged with or disengaged from the back (10), so that the user can use one single hand to operate the engagement and disengagement between the end plug (20) and the back (10), and the operation convenience can be effectively enhanced.

Furthermore, the two sides of the upper sheet (12) of the back (10) have the downward arced edge portions (120) working in conjunction with the inclined expanding sections (310) of the C-shaped portions (31) of the loose-leaf coil (30), so that the bottom edge of each C-shaped portion (31) is formed with the level section (33) having the width equal to the width of the back (10), the number of papers that can be bound can be increased, and the page capacity can be greater than that corresponding to the width of the back (10). Thus, when the books are horizontally stacked or stand on the bookshelf, the front covers of the books can be in direct contact with each other and stacked without being affected by the too-wide back (10). So, the tilting down phenomenon can be prevented, and the overall smoothness and beauty can be enhanced according to its special property.

In summary, it is understood that the creative invention can effectively solve the problems encountered in the prior art, and further significantly enhance the effect. Since there is no product or public use that is the same as the invention with the enhanced effects in this technical field, the invention as filed is novel and cannot be obviously made.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A loose-leaf binder device disposed on a loose-leaf book, the loose-leaf binder device comprising:

a back comprising a lower sheet and an upper sheet, wherein two parallel upright baffles are formed between the lower sheet and the upper sheet, so that a space surrounded by the lower sheet, the upper sheet and the two upright baffles is formed with an insert slot, wherein at least one of two ends of the back is formed with an open end portion, a portion of the upper sheet abutting upon an end edge corresponding to the open end portion is formed with a retaining hole communicating with the insert slot, and a track is formed on each of two opposite outer sides of the two upright baffles between the lower sheet and the upper sheet;

at least one end plug inserted into the open end portion of the back, wherein the end plug comprises a base cover and a plug body for closing one of the two opposite ends of the back, two sides of the plug body are formed with two side tines which are inserted into the tracks of two sides of the back, respectively, a receiving slot is formed between the two side tines, the plug body is integrally formed with a curve-shaped resilient member in the receiving slot, the resilient member may be inserted into the insert slot of the back, a top surface of the resilient member is formed with one post corresponding to the retaining hole of the back, a free end of the resilient member is formed with an upward compressing edge, and the base cover can correspondingly cover an end portion of the plug body, so that an insert space into which an end portion of the back is inserted is formed between an outer surface of the plug body and an inner surface of the base cover, wherein a middle of an end edge of the base cover is formed with a through hole through which the compressing edge projects; and a loose-leaf coil selectively disposed below the back, wherein the loose-leaf coil is formed with continuous C-shaped portions by bending a wire, and each of two ends of each of the C-shaped portions is formed with a track section to slide in the track of the back.

2. The loose-leaf binder device according to claim 1, wherein each of two sides of the upper sheet of the back is formed with a downward extending arced edge portion, and upper sections of two sides of each of the C-shaped portions of the loose-leaf coil are formed with inclined expanding sections corresponding to the arced edge portions of the upper sheet of the back, so that a bottom edge of each of the C-shaped portions is formed with a level section having a width equal to a width of the back, the number of inner papers through which the C-shaped portion passes is increased.

3. The loose-leaf binder device according to claim 1, wherein each of two lateral side edges of the lower sheet of the back is formed with a slightly upwardly projecting flange, the lower sheet is formed with at least one engaging slot on at least one of two ends of the flange, and the engaging slot is for engaging and limiting a track section of the C-shaped portion of the loose-leaf coil.

4. The loose-leaf binder device according to claim 1, wherein a top surface of the post of the resilient member of the end plug is formed with a downward inclined surface corresponding to the back, so that the post of the resilient member is easily snapped into the retaining hole.

* * * * *